US006484357B1

(12) United States Patent
Dong

(10) Patent No.: US 6,484,357 B1
(45) Date of Patent: Nov. 26, 2002

(54) NOZZLE ATTACHMENT FOR A VACUUM CLEANER

(76) Inventor: Shengjie Dong, 645 Falls Bay Ct., Alpharetta, GA (US) 30022

( * ) Notice: Subject to any disclaimer, the term of this patent is extended or adjusted under 35 U.S.C. 154(b) by 0 days.

(21) Appl. No.: 09/909,024

(22) Filed: Jul. 19, 2001

(51) Int. Cl.[7] ..... A47L 9/06
(52) U.S. Cl. ..... 15/397; 15/398
(58) Field of Search ..... 15/397, 398, 400

(56) References Cited

U.S. PATENT DOCUMENTS

| | | | | | |
|---|---|---|---|---|---|
| 925,646 | A | * | 6/1909 | Moorhead | 119/606 |
| 1,042,711 | A | * | 10/1912 | Moorhead | 15/322 |
| 1,042,713 | A | * | 10/1912 | Moorhead | 15/322 |
| 2,276,944 | A | * | 3/1942 | Dow | 15/397 |
| 2,866,221 | A | * | 12/1958 | Warva | 15/176.1 |
| 3,815,171 | A | * | 6/1974 | Carr et al. | 15/369 |
| 4,279,095 | A | | 7/1981 | Aasen | |
| 5,345,651 | A | | 9/1994 | Roberts | |
| 5,440,782 | A | | 8/1995 | Yamashita | |

FOREIGN PATENT DOCUMENTS

| | | | | |
|---|---|---|---|---|
| GB | 19765 | * | 9/1908 | 15/397 |

* cited by examiner

*Primary Examiner*—Chris K. Moore
(74) *Attorney, Agent, or Firm*—Merchant & Gould; Tim Tingkang Xia

(57) ABSTRACT

A nozzle attachment for a vacuum cleaner. In one embodiment, the nozzle attachment includes a plurality of open-ended tubes, where the tubes are parallel to one another axially and each of the tubes is in contact with at least one other tube side by side so as to form an array of the tubes. The nozzle attachment also has a plurality of bristle members forming a brush, and an adapter having a first end and a second end, an interior chamber extending between the first end and the second end, and a mouth at the second end, the first end connectable to a vacuum source of the vacuum cleaner so as to provide suction and the second end being adapted to receive therein the array of the tubes and the brush through the mouth. The array of the tubes and the brush are positioned in a fixed side by side relationship and the tubes are in flow communication with the vacuum source of the vacuum cleaner through the interior chamber of the adapter. Additionally, the nozzle attachment has means for holding the array of the tubes and the brush in the fixed side by side relationship.

21 Claims, 4 Drawing Sheets

NOZZLE ATTACHMENT FOR A VACUUM CLEANER

CROSS-REFERENCE TO RELATED PATENT APPLICATION

This application claims the benefits of Chinese Patent Application No. 01222632.7, filed May 15, 2001, which status is pending.

BACKGROUND OF THE INVENTION

1. Field of the Invention

This invention relates to a nozzle attachment for a vacuum cleaner. More particularly, this invention relates to a nozzle attachment for a vacuum cleaner that allows gentle, effective, sufficient and safe cleaning of intricate, hard to reach, and other surfaces and has combined functions both as a broom and a vacuum machine.

2. The Prior Art

It is known that vacuum cleaner has revolutionized people's daily life by utilizing a suction force offered by a vacuum source to collect dust and debris from various surfaces.

It is also known to provide vacuum cleaner head having bristles and arranged so that dust and debris disturbed in use by brushing over a surface is drawn into a vacuum cleaner. The bristled head is usually fitted to an end of a rigid tube which is in turn connected via a flexible tube to a vacuum cleaner body. The bristled head may be somewhat loosely connected to the rigid tube to provide some relative movement during use of the vacuum cleaner.

In particular, efforts have been made in the art to combine the suction force offered by a vacuum source such as a vacuum cleaner and the sweeping power of a broom to form new cleaning device for better performance. For example, U.S. Pat. No. 4,279,095 discloses an array of pliable fingers being used with a vacuum source and communicating with plural, flexible tubes to remove fleas from pets.

Additionally, U.S. Pat. No. 5,345,651 discloses a nozzle assembly for a vacuum cleaner that has a brush and a plurality of flexible tubes being inserted within brush. As clearly shown in FIGS. 2 and 3, a plurality of tubes 12, which provide suction force, are evenly aligned within brush 10 at precise spaced locations. The space between the tubes are filled by bristle members.

However, because the tubes are spaced separately from each other, it provides insufficient suction force for the purpose of cleaning some types of surfaces. Moreover, the required alignment of the tubes may make the manufacturing process cumbersome and time consuming. Additionally, because the mixture of the tubes and the bristle members, debris such as hairs entangled with the bristle members may block the air intaking of the tubes and thus further weaken the suction force of the nozzle assembly.

SUMMARY OF THE INVENTION

The above-noted disadvantages of the prior art are overcome by the present invention, which in one aspect is a nozzle attachment for a vacuum cleaner. In one embodiment, the nozzle attachment includes a plurality of open-ended tubes, where the tubes are parallel to one another axially and each of the tubes is in contact with at least one other tube side by side so as to form an array of the tubes. The nozzle attachment also has a plurality of bristle members forming a brush, and an adapter having a first end and a second end, an interior chamber extending between the first end and the second end, and a mouth at the second end, where the first end is connectable to a vacuum source of the vacuum cleaner so as to provide suction and the second end is adapted to receive therein the array of the tubes and the brush through the mouth. The array of the tubes and the brush are positioned in a fixed side by side relationship and the tubes are in flow communication with the vacuum source of the vacuum cleaner through the interior chamber of the adapter. Additionally, the nozzle attachment has means for holding the array of the tubes and the brush in the fixed side by side relationship.

In one embodiment of the present invention, the tubes are comprised of flexible material. Moreover, the tubes are of shorter length than the bristles and of annular cross section. As formed, the array of the tubes can be substantially of a semi-circle shape crosssectionally, a rectangular shape cross-sectionally, or an annular shape cross-sectionally. Likewise, the brush can be substantially of a semi-circle shape cross-sectionally, a rectangular shape cross-sectionally, or an annular shape cross-sectionally.

In another aspect, the invention includes a nozzle attachment for a vacuum cleaner. In one embodiment, the nozzle attachment includes a plurality of open-ended tubes, wherein the tubes are parallel to one another axially and each of the tubes is in contact with at least one other tube side by side so as to form an array of the tubes. The nozzle attachment also includes a plurality of bristle members forming a first brush and a plurality of bristle members forming a second brush. Moreover, the nozzle attachment has an adapter having a first end and a second end, an interior chamber extending between the first end and the second end, and a mouth at the second end, where the first end is connectable to a vacuum source of the vacuum cleaner so as to provide suction and the second end is adapted to receive therein the array of the tubes, the first brush and the second brush through the mouth. The array of the tubes is positioned between the first brush and the second brush and the tubes are in flow communication with the vacuum source of the vacuum cleaner through the interior chamber of the adapter. Additionally, the nozzle attachment include means for holding the array of the tubes and the first brush and the second brush in a fixed relationship, in which the array of the tubes is positioned between the first brush and the second brush.

In yet another aspect, the invention includes a nozzle attachment for a vacuum cleaner. In one embodiment, the nozzle attachment includes a plurality of open-ended tubes, where the tubes parallel to one another axially and each of the tubes in contact with at least one other tube side by side so as to form an array of the tubes. The nozzle attachment also includes a plurality of bristle members forming a brush, where the brush is formed to at least partially encircle the array of the tubes. Moreover, the nozzle attachment has an adapter having a first end and a second end, an interior chamber extending between the first end and the second end, and a mouth at the second end, the first end connectable to a vacuum source of the vacuum cleaner so as to provide suction and the second end being adapted to receive therein the array of the tubes and the brush through the mouth. The array of the tubes is encircled at least partially by the brush and the tubes are in flow communication with the vacuum source of the vacuum cleaner through the interior chamber of the adapter. Additionally, the nozzle attachment further has means for holding the array of the tubes and the brush in a fixed relationship, in which the array of the tubes is encircled at least partially by the brush.

These and other aspects will become apparent from the following description of the preferred embodiment taken in conjunction with the following drawings, although variations and modifications may be effected without departing from the spirit and scope of the novel concepts of the disclosure.

DETAILED DESCRIPTION OF THE INVENTION

Figure 1:
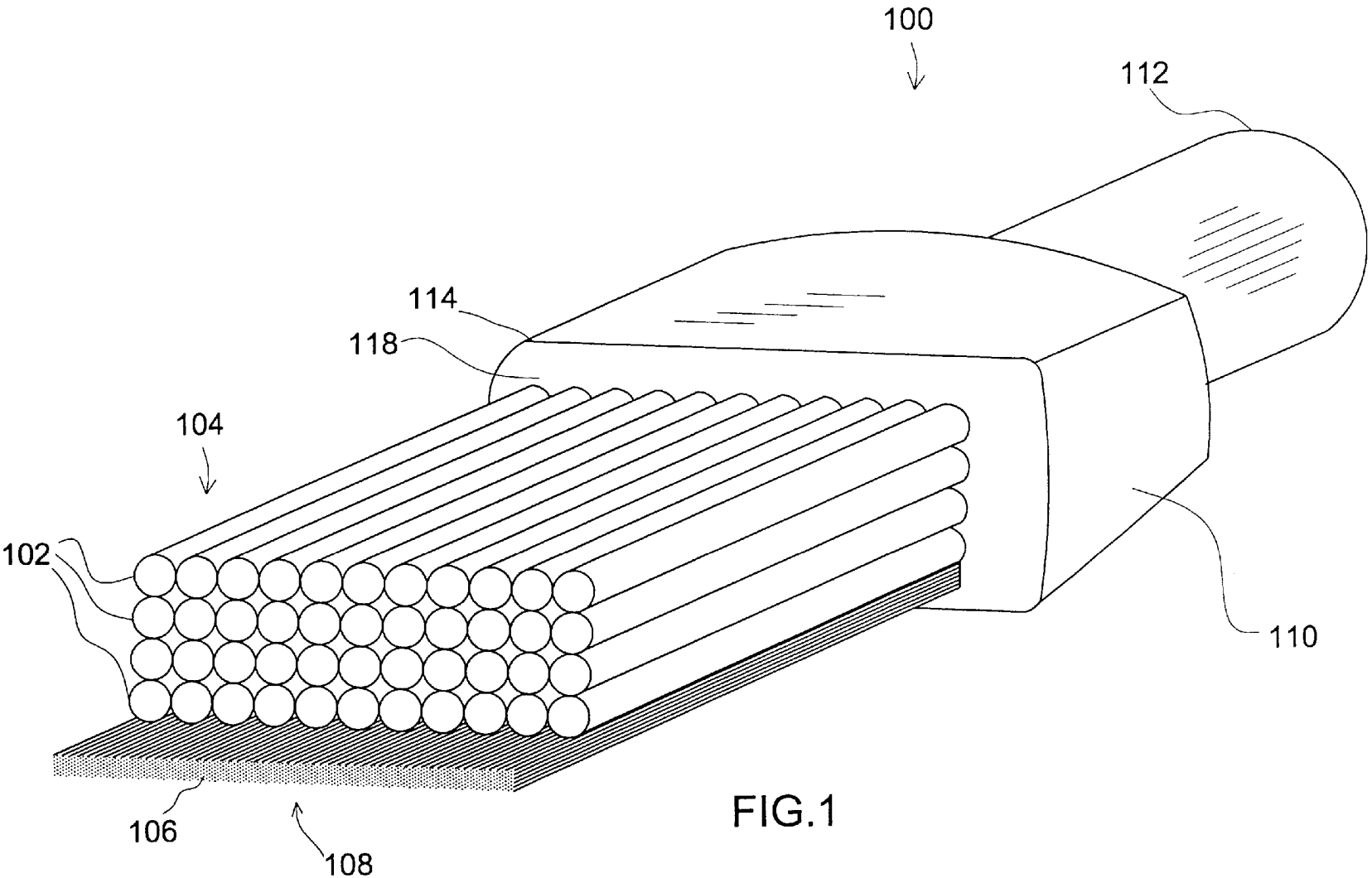
FIG. 1 is a perspective view of a nozzle attachment in one embodiment in accordance with the present invention.
Figure 2:
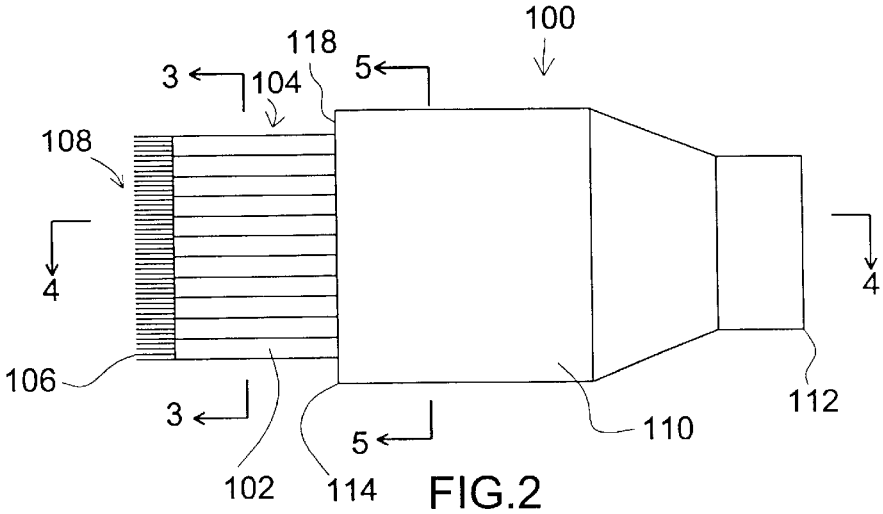
FIG. 2 is a side view showing the nozzle attachment as shown in FIG. 1.

Various embodiments of the invention are now described in detail. Referring to the drawings, like numbers indicate like parts throughout the views. As used in the description herein and throughout the claims that follow, the meaning of "a," "an," and "the" includes plural reference unless the context clearly dictates otherwise. Also, as used in the description herein and throughout the claims that follow, the meaning of "in" includes "in" and "on" unless the context clearly dictates otherwise.

Figure 3:
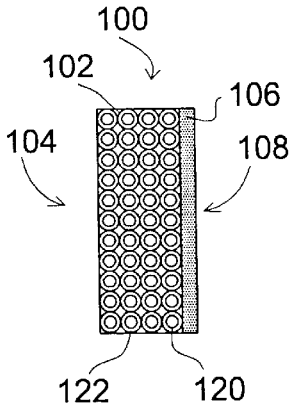
FIG. 3 is an end view showing the end of a nozzle attachment as shown in FIG. 1 that does the cleaning.
Figure 4:
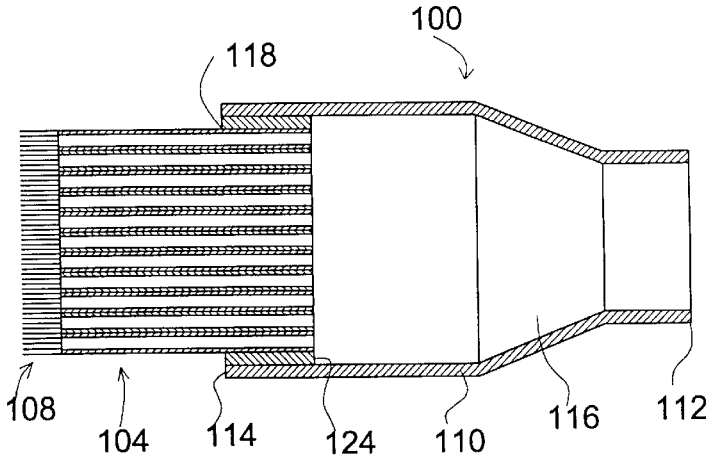
FIG. 4 is a section view showing a lengthwise cut through the nozzle attachment as shown in FIG. 1.

Referring first to FIGS. 1–5, a first embodiment of the nozzle attachment of the invention is shown. In this embodiment, the nozzle attachment 100 includes a plurality of open-ended tubes 102, where the tubes 102 are parallel to one another axially and each of the tubes is in contact with at least one other tube side by side so as to form an array 104 of the tubes. The nozzle attachment 100 also has a plurality of bristle members 106 forming a brush 108, and an adapter 110 having a first end 112 and a second end 114, an interior chamber 116 extending between the first end 112 and the second end 114, and a mouth 118 at the second end 114. The first end 112 is connectable to a vacuum source of the vacuum cleaner (not shown) so as to provide suction and the second end 114 is adapted to receive therein the array 104 of the tubes 102 and the brush 108 through the mouth 118. The array 104 of the tubes 102 and the brush 108 are positioned in a fixed side by side relationship, as best shown in FIG. 3, for example. The array 104 contains at least one column of tubes. In the embodiment shown in FIG. 3, the array 104 has a boundary column 120 of tubes neighboring the brush 108 and columns 122 of tubes, where columns 122 of tubes are separated from the brush 108 and there are substantially no bristle members in the array 104 of tubes. Indeed, because tubes 102 contact each other axially, there is substantially no space left between the tubes for bristle members. The tubes 102 are in flow communication with the vacuum source of the vacuum cleaner through the interior chamber 116 of the adapter 110. Because the tubes 102 are clustered together to form the array 104, unlike in the prior art where the tubes are spaced apart, the array 104 provides a stronger and sufficient suction force. Moreover, because each of tubes 102 has a small cross section than an ordinary air in-taking nozzle of a vacuum source, the suction force provided by the array 104 are gentle enough to be used to clean delicate objects such as furniture, paintings, collectibles, appliances, etc. Additionally, the nozzle attachment 100 has means 124 for holding the array 104 of the tubes 102 and the brush 108 in the fixed side by side relationship.

Figure 7:
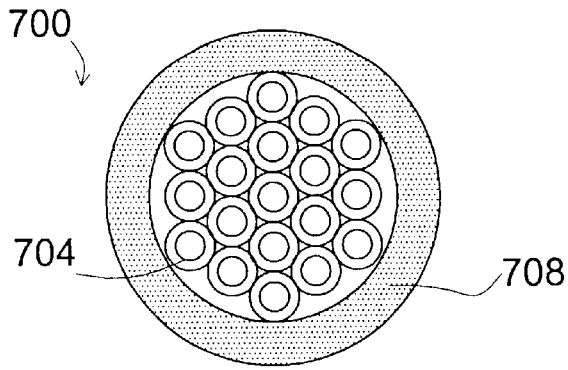
FIGS. 7 is an end view showing the end of a nozzle attachment according to a fourth embodiment of the present invention that does the cleaning.
Figure 8:
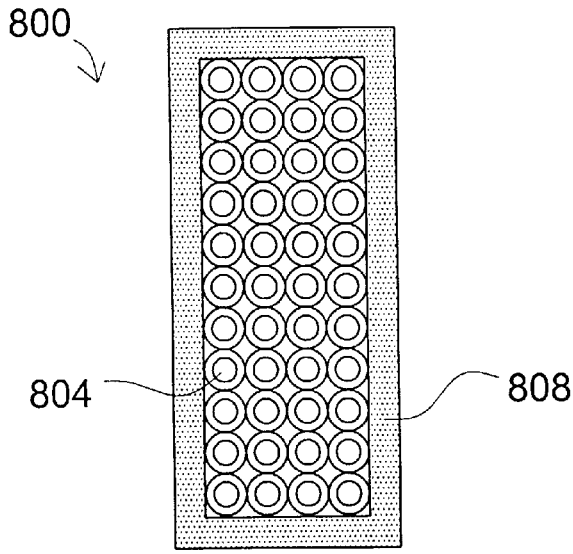
FIG. 8 is an end view showing the end of a nozzle attachment according to a fifth embodiment of the present invention that does the cleaning.
Figure 9:
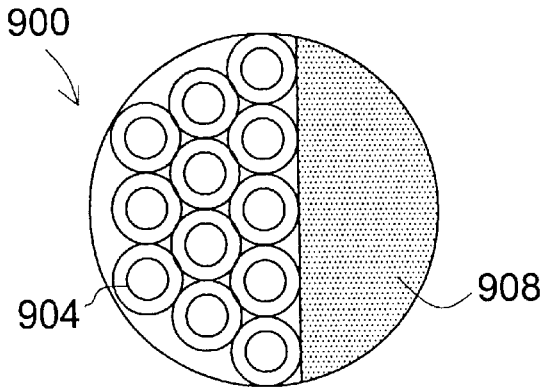
FIG. 9 is an end view showing the end of a nozzle attachment according to a sixth embodiment of the present invention that does the cleaning.

In one embodiment of the present invention, the tubes 102 are comprised of flexible material. For example, tubes can be composed of material such as nylon, polyethylene or other proper materials that is both flexible and strong. Moreover, the tubes are of shorter length than the bristles and of annular cross section. Cross-section wise, tubes can have different sizes to accommodate the intended purpose of the nozzle attachment 100. For example, one can increase the cross section size of the tubes to provide stronger suction force. Or, alternatively, one can reduce the cross section size of the tubes to provide gentler suction force. Moreover, as formed, the array of the tubes can be substantially of a semi-circle shape cross-sectionally as shown in FIG. 9, a rectangular shape cross-sectionally as shown in FIGS. 3, 5, 6 and 8, or an annular shape cross-sectionally as shown in FIG. 7.

In one embodiment of the present invention, the brush 108 is of uniform cross section comprising soft, durable bristle members 106. The bristle members 106 can be of similar quality to those used for broom for household daily cleaning. Alternatively, the bristle members 106 can be of similar quality to those used for painting. Moreover, the bristle members 106 may also be composed of goat hair, horse hair, or synthetic materials of varying diameters such as polystyrene, nylon, polyethylene, or polypropylene. Brush 108 typically has the working end being rounded or beveled. Brush 108 extends roughly 10 mm to 100 mm beyond the end of tubes. As formed, the brush 108 can be substantially of a semi-circle shape cross-sectionally as shown in FIG. 8, a rectangular shape cross-sectionally as shown in FIGS. 3, 5 and 7, or an annular shape cross-sectionally as shown in FIG. 6.

Figure 5:
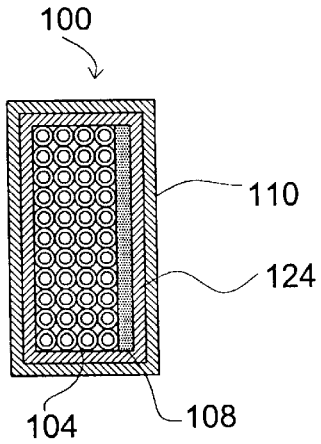
FIG. 5 is an end view showing the end of a nozzle attachment according to a second embodiment of the present invention that does the cleaning.
Figure 10:
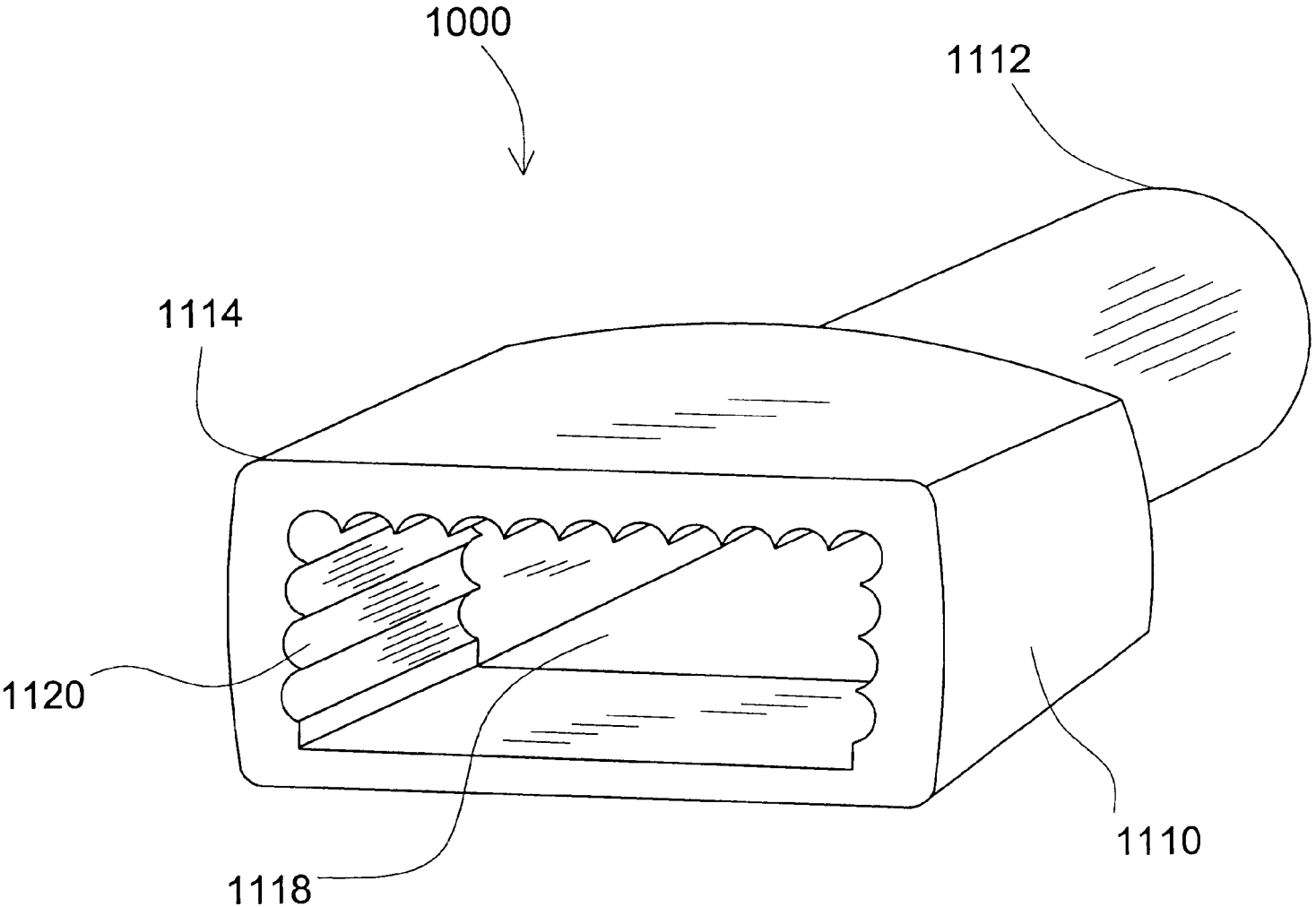
FIG. 10 is a perspective view showing the second end of an adapter of a nozzle attachment according to one embodiment of the present invention.

FIG. 5 shows one embodiment of means 124 for holding the array 104 of the tubes 102 and the brush 108 in the fixed side by side relationship. In this embodiment, holding means 124 is an optional clamp 124 around the array 104 of tubes and brush 108. After the array 104 of tubes 102 and the brush 104 are aligned in a side to side relationship, clamp 124 is tightened around the base of brush and tubes, firmly securing tubes within brush in an efficient arrangement. Clamp 124 is typically made of metal and is similar in design to those used on common paint brushes. Alternatively, holding means 124 can be made from rubber, nylon, strings, or other resilient materials. For example, one may use a rubber band to bind the tubes and the broom together and then fit the combination into the adapter 110. Moreover, as shown in FIG. 10, holding means can be a plurality of grooves 1120 located at the mouth 1118 of an adapter 1110 according to one embodiment of the present invention. Grooves 1120 are sized to receive tubes and hold tubes therein. In one embodiment, the adapter 1110 can be molded from rubber or PVC material or other similar materials with grooves 1120 located at the mouth as an integral piece. Thus, in this embodiment, grooves 1120 function as the holding means for the array of tubes. Grooves 1120 can be distributed around the whole mouth 1118. Or, alternatively, grooves 1120 can be distributed around part of the mouth 1118.

In one embodiment, as shown in FIGS. 1–5, the nozzle attachment 100 has an adapter 110 that is formed around the exterior of holding means 124. Adapter 110 is typically made of plastic. Adapter 110 may vary in size and shape depending on the size and shape of the array 104 and the brush 108 and the size and shape of a vacuum source to such as a suction hose for a motorized vacuum which the nozzle attachment 100 will be attached. Additionally, adapter 110 can be dressed or encircled at the outer surface of the adapter 110 with a sleeve of soft, flexible material (not shown) such as sponge, rubber, cloth or other materials. Note that in FIGS. 1–5, it is shown the adapter 110 has a larger dimension at the second end 114 than the first end 112. Alternatively, the adapter 110 can have an equal or smaller dimension at the second end 114 than the first end 112. Furthermore, in one embodiment of the present invention, the adapter 110 and the tubes 102 can be molded together from rubber, PVC, or other plastic materials to form a one-piece device.

Figure 6:
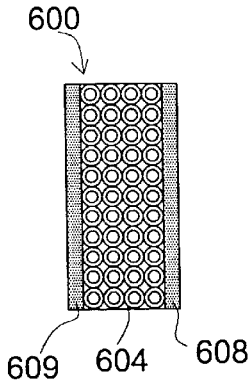
FIG. 6 is an end view showing the end of a nozzle attachment according to a third embodiment of the present invention that does the cleaning.

An additional embodiment is shown in FIG. 6. This embodiment is the same as the previous embodiment as shown in FIGS. 1–5 except that the array 604 of tubes is positioned between a first brush 608 and a second brush 609 to form a nozzle attachment 600.

Yet another embodiment is shown in FIG. 7. This embodiment is the same as the previous embodiment as shown in FIGS. 1–5 except that the array 704 of tubes has a cylindrical cross section and is encircled by a brush 708 to form a nozzle attachment 700.

Yet a further embodiment is shown in FIG. 8. This embodiment is the same as the previous embodiment as shown in FIGS. 1–5 except that the array 804 of tubes has a rectangular cross section and is encircled by a brush 808 to form a nozzle attachment 800.

Yet an additional embodiment is shown in FIG. 9. This embodiment is the same as the previous embodiment as shown in FIGS. 1–5 except that the array 904 of tubes having a semiannular cross section and the brush 908 having a semi-annular cross section to form a nozzle attachment 900.

From the description above, among other things, a number of advantages of a nozzle attachment according to the present invention become evident:

(a) the cluster of tubes forming an array of tubes provides sufficient yet not too strong suction force.

(b) the separation of the array of tubes and the brush prevents debris entangled with the brush to affect the performance of the tubes yet keeps the benefits of combining the suction force of the tubes and the sweeping power of the brush.

(c) the nozzle attachment as a whole can be "soft" so it will cause no damage to the object(s) to be cleaned.

(d) the nozzle attachment can be made in various types of shapes for various cleaning purposes. For example, nozzle attachment 100 can be utilized to reach easily tight spaces because of its rectangular cross section.

(e) the flexibility of the working end of brush enables the bristles to reach minute or hard to get at places that are soiled.

(f) the proximity of the end of tubes to the end of the bristles allow dusts and debris to be efficiently removed from a surface being cleaned, where the cleaning performance is enhanced because the brush stirs up the dusts and debris for the tubes to vacuum.

(g) the nozzle attachment includes a minimum amount of parts and materials.

(h) a brushing motion applied by a user on the surface being cleaned provides speedy and effective cleaning of areas that would otherwise be difficult and time consuming to clean.

The above described embodiments are given as an illustrative examples only. It will be readily appreciated that many deviations may be made from the specific embodiment disclosed in this specification without departing from the invention. Accordingly, the scope of the invention is to be determined by the claims below rather than being limited to the specifically described embodiment above.

What is claimed is:

1. A nozzle attachment for a vacuum cleaner, comprising:

(a) a plurality of open-ended tubes, the tubes parallel to one another axially and each of the tubes in contact with at least one other tube side by side so as to form an array of the tubes;

(b) a plurality of bristle members forming a brush; and (c) an adapter having a first end and a second end, an interior chamber extending between the first end and the second end, and a mouth at the second end, the first end connectable to a vacuum source of the vacuum cleaner so as to provide suction and the second end being adapted to receive therein the array of the tubes and the brush through the mouth, wherein the array of the tubes and the brush are positioned in a fixed side by side relationship and the tubes are in flow communication with the vacuum source of the vacuum cleaner through the interior chamber of the adapter.

2. The nozzle attachment of claim 1, further comprising means for holding the array of the tubes and the brush in the fixed side by side relationship.

3. The nozzle attachment of claim 1, wherein the tubes are of shorter length than the bristles.

4. The nozzle attachment of claim 1, wherein the tubes are comprised of flexible material.

5. The nozzle attachment of claim 1, wherein the tubes are of annular cross section.

6. The nozzle attachment of claim 1, wherein the brush is substantially of a semi-circle shape cross-sectionally.

7. The nozzle attachment of claim 1, wherein the brush is substantially of a rectangular shape cross-sectionally.

8. The nozzle attachment of claim 1, wherein the brush is substantially of an annular shape cross-sectionally.

9. The nozzle attachment of claim 1, wherein the array of the tubes is substantially of a semi-circle shape cross-sectionally.

10. The nozzle attachment of claim 1, wherein the array of the tubes is substantially of a rectangular shape cross-sectionally.

11. The nozzle attachment of claim 1, wherein the array of the tubes is substantially of an annular shape cross-sectionally.

12. The nozzle attachment of claim 1, wherein the mouth of the adapter is substantially of a rectangular shape cross-sectionally.

13. The nozzle attachment of claim 1, wherein the mouth of the adapter is substantially of an annular shape cross-sectionally.

14. The nozzle attachment of claim 1, wherein the adapter is comprised at least partially of flexible material.

15. The nozzle attachment of claim 14, further comprising a sleeve of flexible material encircling the outer surface of the adapter.

16. The nozzle attachment of claim 14, wherein the adaptor has a plurality of grooves at the mouth for receiving the array of tubes.

17. A nozzle attachment for a vacuum cleaner, comprising:

(a) a plurality of open-ended tubes, the tubes parallel to one another axially and each of the tubes in contact with at least one other tube side by side so as to form an array of the tubes;

(b) a plurality of bristle members forming a first brush;

(c) a plurality of bristle members forming a second brush; and (d) an adapter having a first end and a second end, an interior chamber extending between the first end and the second end, and a mouth at the second end, the first end connectable to a vacuum source of the vacuum cleaner so as to provide suction and the second end being adapted to receive therein the array of the tubes, the first brush and the second brush through the mouth, wherein the array of the tubes is positioned between the first brush and the second brush and the tubes are in flow communication with the vacuum source of the vacuum cleaner through the interior chamber of the adapter.

18. The nozzle attachment of claim 17, further comprising means for holding the array of the tubes and the first brush and the second brush in a fixed relationship wherein the array of th e tubes is positioned between the first brush and the second brush.

19. The nozzle attachment of claim 17, wherein the tubes are comprised of flexible material.

20. A nozzle attachment for a vacuum cleaner, comprising:

(a) a plurality of open-ended tubes, the tubes parallel to one another axially and each of the tubes in contact with at least one other tube side by side so as to form an array of the tubes;

(b) a plurality of bristle members forming a brush, the brush being formed to at least partially encircle the array of the tubes; and (c) an adapter having a first end and a second end, an interior chamber extending between the first end and the second end, and a mouth at the second end, the first end connectable to a vacuum source of the vacuum cleaner so as to provide suction and the second end being adapted to receive the rein the array of the tubes and the brush through the mouth, wherein the array of the tubes is encircled at least partially by the brush and the tubes are in flow communication with the vacuum source of the vacuum cleaner through the interior chamber of the adapter.

21. The nozzle attachment of claim 20, further comprising means for holding the array of the tubes and the brush is a fixed relationship wherein the array of the tubes is encircled at least partially by the brush.

* * * * *